US005343592A

United States Patent [19]

Parise

[11] Patent Number: 5,343,592

[45] Date of Patent: Sep. 6, 1994

[54] HOT WATER VACUUM EXTRACTION MACHINE WITH SUBMICRON SIZE PARTICLE

[75] Inventor: Carl Parise, Reno, Nev.

[73] Assignee: Thermax, Reno, Nev.

[21] Appl. No.: 133,288

[22] Filed: Oct. 8, 1993

[51] Int. Cl.[5] ..... A47L 9/18

[52] U.S. Cl. ..... 15/353; 55/320; 55/439; 55/259; 55/465

[58] Field of Search ..... 15/321, 353; 55/320, 55/439, 259, 465

[56] References Cited

U.S. PATENT DOCUMENTS

| | | | |
|---|---|---|---|
| 3,821,830 | 7/1974 | Sundheim | 15/353 X |
| 4,055,405 | 10/1977 | Thun-Hohenstein | 15/355 X |
| 4,078,908 | 3/1978 | Blackman | 15/353 X |
| 4,083,705 | 4/1978 | Parise et al. | 15/353 X |
| 4,145,198 | 3/1979 | Laule | 55/439 |
| 4,251,241 | 2/1981 | Bothun | 15/353 X |
| 4,287,635 | 9/1981 | Jacobs | 15/353 X |
| 4,367,565 | 1/1983 | Parise | 15/321 |

*Primary Examiner*—Chris K. Moore

*Attorney, Agent, or Firm*—Sughrue, Mion, Zinn, Macpeak & Seas

[57] ABSTRACT

A submicron size particle filter is mounted within a hot water vacuum extraction machine beneath a vertical riser tube which extends upwardly from an outer casing bottom wall. The riser tube is subject to vacuum pressure to remove contaminant and liquid free air from a recovery tank. An air filter chamber open to the lower end of the riser tube carries the secondary filter holder assembly consisting of a perforate secondary filter holder about an open pore filter element to filter out contaminants of submicron size. The secondary filter holder is formed of an open frame circular base member with a filter disk retaining ring snap fitted thereto and sandwiching the open pore filter element.

10 Claims, 5 Drawing Sheets

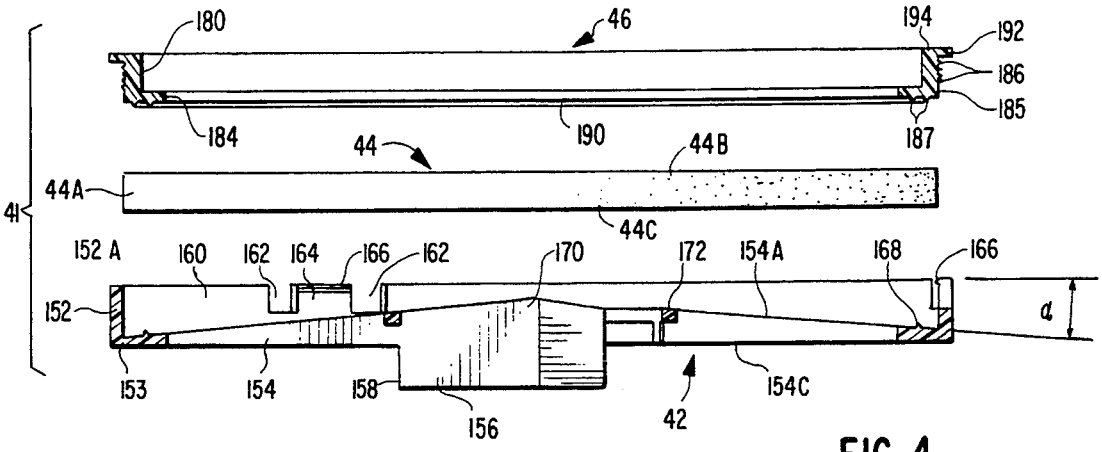
FIG. 4
FIG. 5
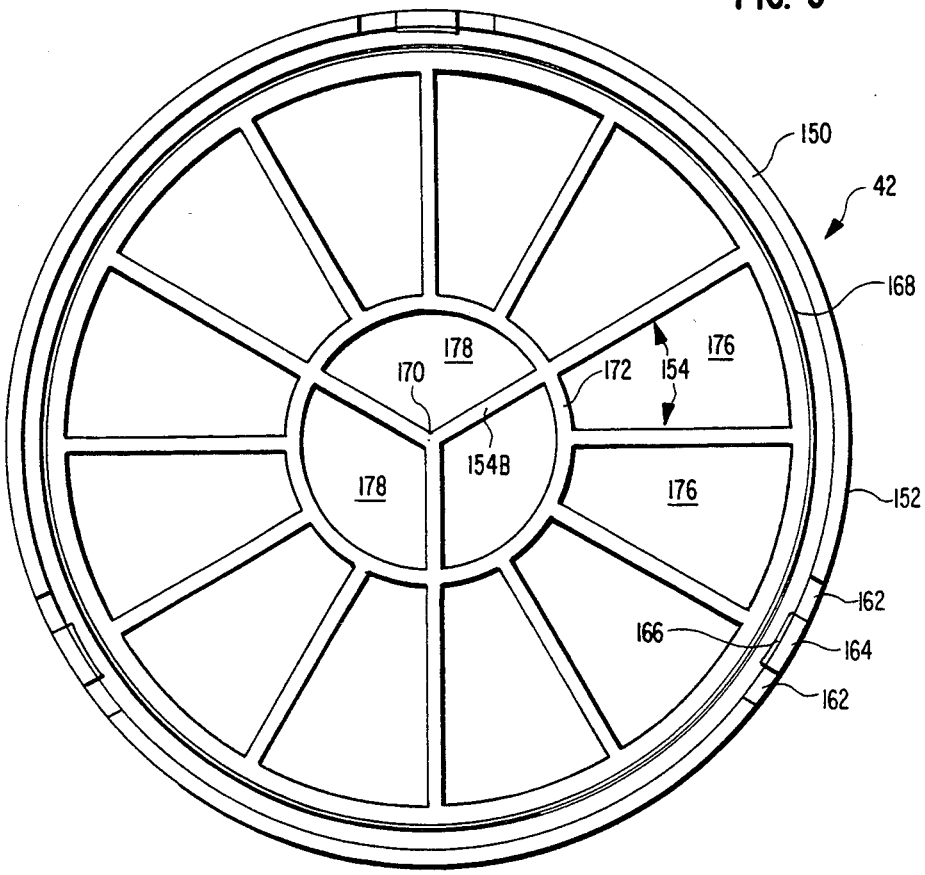

FIG.5A
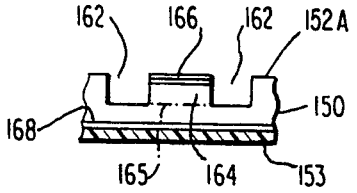
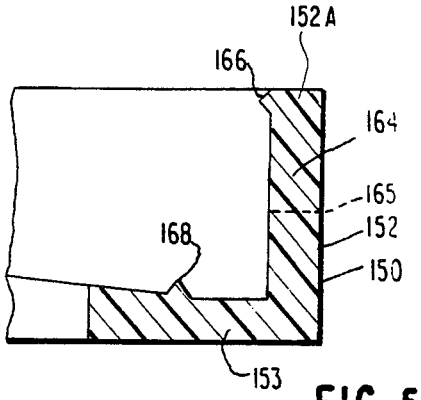
FIG.5B
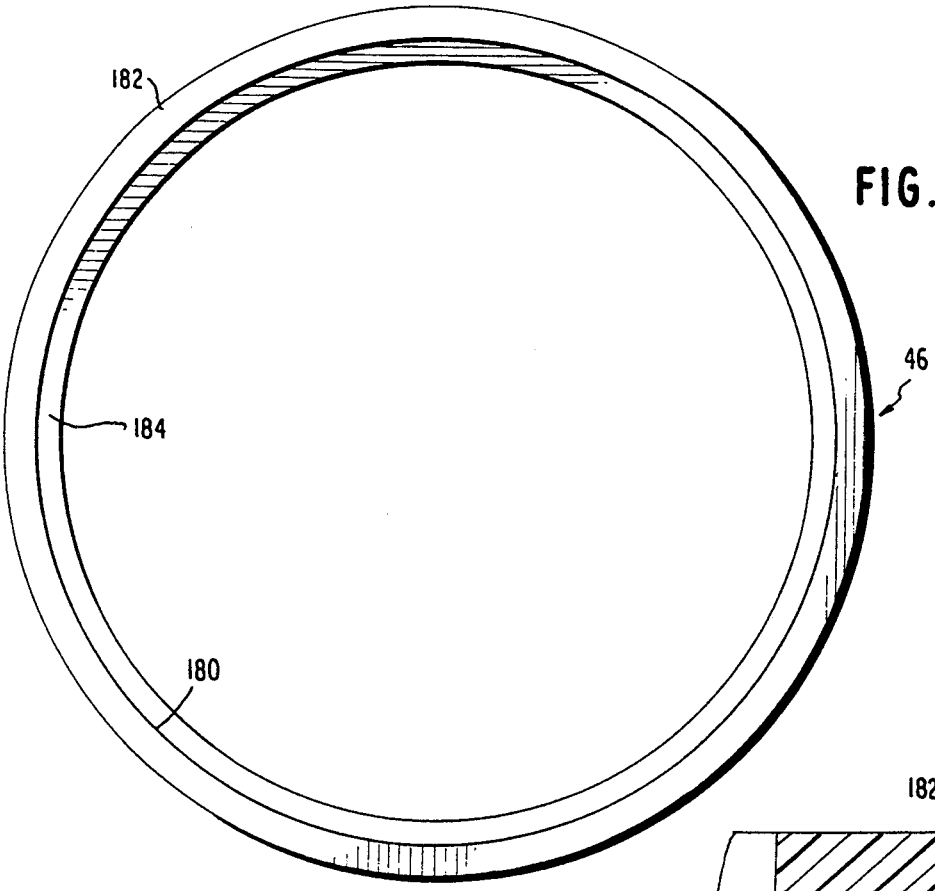
FIG.6
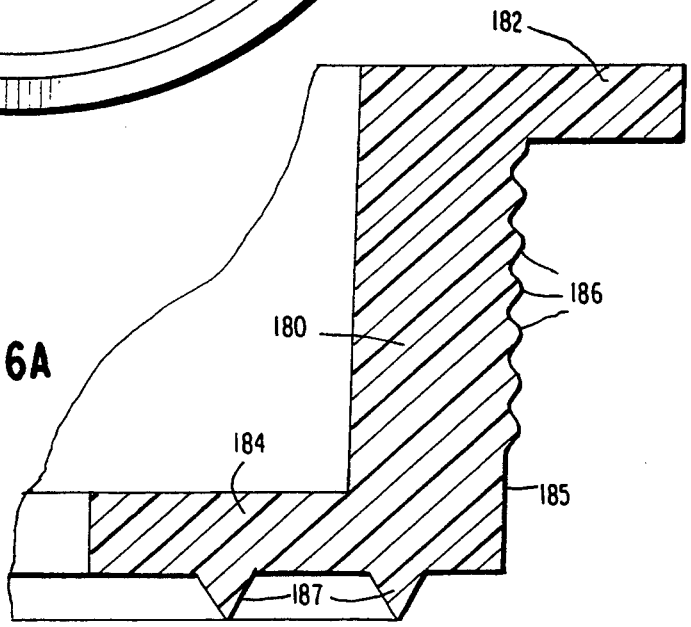
FIG.6A

HOT WATER VACUUM EXTRACTION MACHINE WITH SUBMICRON SIZE PARTICLE

FIELD OF THE INVENTION

This invention relates to hot water vacuum cleaners in which atomized, detergent-containing hot water may be sprayed on objects to be cleaned such as rugs and other floor surfaces and suction removed, and more particularly to such a unit which employs a secondary urethane foam filter or an electrostatically charged 100% efficient disposable allergy filter, leading to a dust-free, allergy-free operation by trapping submicron sized contaminants and allergants for easy disposal.

BACKGROUND OF THE INVENTION

This invention is an outgrowth of personal size, home use hot water vacuum extraction machines incorporating within a dump bucket employed in both wet and dry vacuum systems of a hydro air filter having an end of the hydro air filter immersed in water within the dump bucket. Such systems cause dirty air under vacuum pressure returning to the dump bucket from a vacuum cleaner to a vacuum head mix with the water accumulating within the bucket, or provided to the same. The dirt particles separate from the air stream and are retained by the water. The dirt-free air stream is released to a space defined by the top of the bucket and an overlying dome cover and then passes downwardly through a riser tube under suction pressure from a vacuum pump coupled to the lower end of the riser tube. Air, thus escapes from the dump bucket and after passage through the suction pump, is permitted to pass laterally through openings within the wet vacuum extreme casing to which the dump bucket is removably mounted.

The hydro air filter or aqua filter is an improvement in a developing field of small size home vacuum extraction machines exemplified by, U.S. Pat. No. 4,078,908, issued Mar. 14, 1978 to R. Eugene Blackman and entitled "DUMP BUCKET FOR A WET-DRY VACUUM SYSTEM HAVING IMPROVED LIQUID FLOW CHARACTERISTICS"; U.S. Pat. No. 4,083,705, issued Apr. 11, 1978 to Carl Parise et al. and entitled "DUMP BUCKET FOR A WET/DRY VACUUM SYSTEM"; and U.S. Pat. No. 4,145,198, issued Mar. 20, 1979 to Thomas M. Laule and entitled "SINGLE TUBE HYDRO AIR FILTER WITH DIVIDING WALL".

Such machines, whether used as a dry vacuum cleaner or a wet vacuum cleaner, eliminate a problem in the dry vacuum cleaner art which has existed for many, many years. Typically, a dry vacuum cleaner employs a porous bag, within which air is drawn by vacuum pressure from a electric motor driven vacuum pump, which sucks into the bag, dust particles from a rug or other surface being cleaned through a vacuum head. The largest of the dust and dirt particles are retained internally of the bag. The very nature of the dry vacuum cleaner porous bag operation requires that the air stream entering the bag escape through the pores of the bag. Any-dust particles which are sized less than the size of the pores obviously escape through those pores, returning to the room being cleaned an atmosphere of small dust particles floating around after cleaning has been terminated. Such vacuum cleaning processes are inefficient, since they disturb the dirt particles which are dormant within the rug and while extracting and separating the larger dirt particles and create a room atmosphere of millions of small dust particles. Such particles may be easily seen in the sunlight streaming through a window within a room subject to conventional dry vacuum cleaning.

Some of the hot vacuum extraction machines, as set forth in the above identified patents, have within the machine casing and disposed in the path of the return air passing downwardly through the riser duct opening to the suction side of the vacuum pump, a porous structure filter such as a thin porous pad which functions primarily to remove coalesced water particles traveling with the air stream. To some degree, any particles escaping from an area above the water level within the dump tank are carried downwardly through the riser tube and are captured within the pores of the filter pad.

In the ensuing years, the public has become more and more conscious of air contamination. Many Americans who are smokers have given up the habit. Non-smokers are aware of secondary smoke inhalation. Indeed, workplaces today have been rendered cigarette smoke free to address such concerns. Restaurants have either become smoker free, or have segregated non-smoking sections for their patrons. There is therefore a need for removing all particles, even of submicron size to render the home, office areas, restaurants or the like 100% particle free.

It is therefore a primary object of the present invention to provide an improved home use, lightweight hot water vacuum extraction machine which can effectively clean rugs, floors, drapes, upholstery and the like, while rendering the atmosphere of the cleaning area dust free and allergy free by trapping all air contaminants and allergies, down to submicron size.

It is a further object of this invention to provide an improved hot water vacuum extraction machine which employs alternatively a urethane foam filter pad for trapping larger sized contaminant particles in excess of submicron size, or an electrostatic allergy filter pad which is capable of trapping all air contaminants and allergants down to submicron size.

BRIEF DESCRIPTION OF THE DRAWINGS

FIG. 4 is an exploded view of the snap fit, two-part filter holder and an electrostatic allergy filter pad of circular disk form forming a filter assembly of one embodiment of the improved hydropneumatic filter system of the present invention.

FIG. 5 is a plan view of a filter base member the two-part filter holder of FIG. 3.

FIG. 5A is a vertical sectional view of part of the filter base member of FIG. 5.

FIG. 5B is an enlarged radial sectional view of the filter base member of FIG. 5.

FIG. 6 is a top plan view of the filter disk retaining ring of the filter assembly.

FIG. 6A is an radial sectional view of the filter disk retaining ring of FIG. 6.

DESCRIPTION OF THE PREFERRED EMBODIMENT

Figure 1:
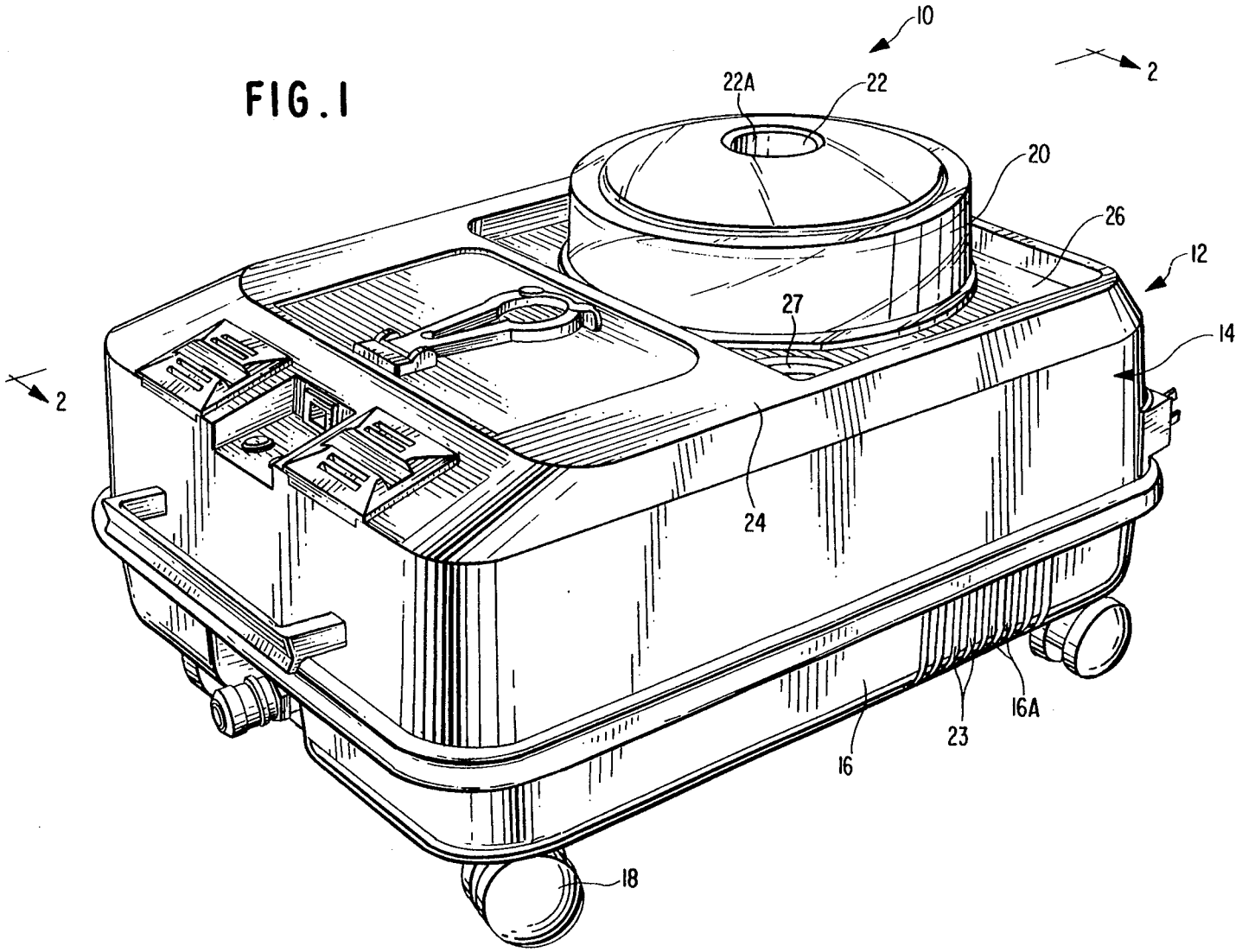
FIG. 1 is perspective view of an improved hot water vacuum extraction system with an improved hydropneumatic filter system which traps all air contaminants and allergants down to submicron particle size and which forms a preferred embodiment of the invention.

Referring to the drawings, the improved wet/dry vacuum extraction machine forming a preferred embodiment of the invention is indicated generally at 10 and is formed of a number of main components or elements. As seen in FIG. 1, the hot water vacuum extraction machine 10, which may operate in a dry or wet mode includes a casing indicated generally at 12 formed of injection molded plastic, as are the majority of the components of the machine. The casing 12 consists of a upper case 14 and a lower case 16 of elongated rectangular plan configuration. The upper case supports a removable, lockable dome 20. The makeup of the basic components of the machine 10 conforms to that of U.S. Pat. No. 4,367,565.

Figure 2:
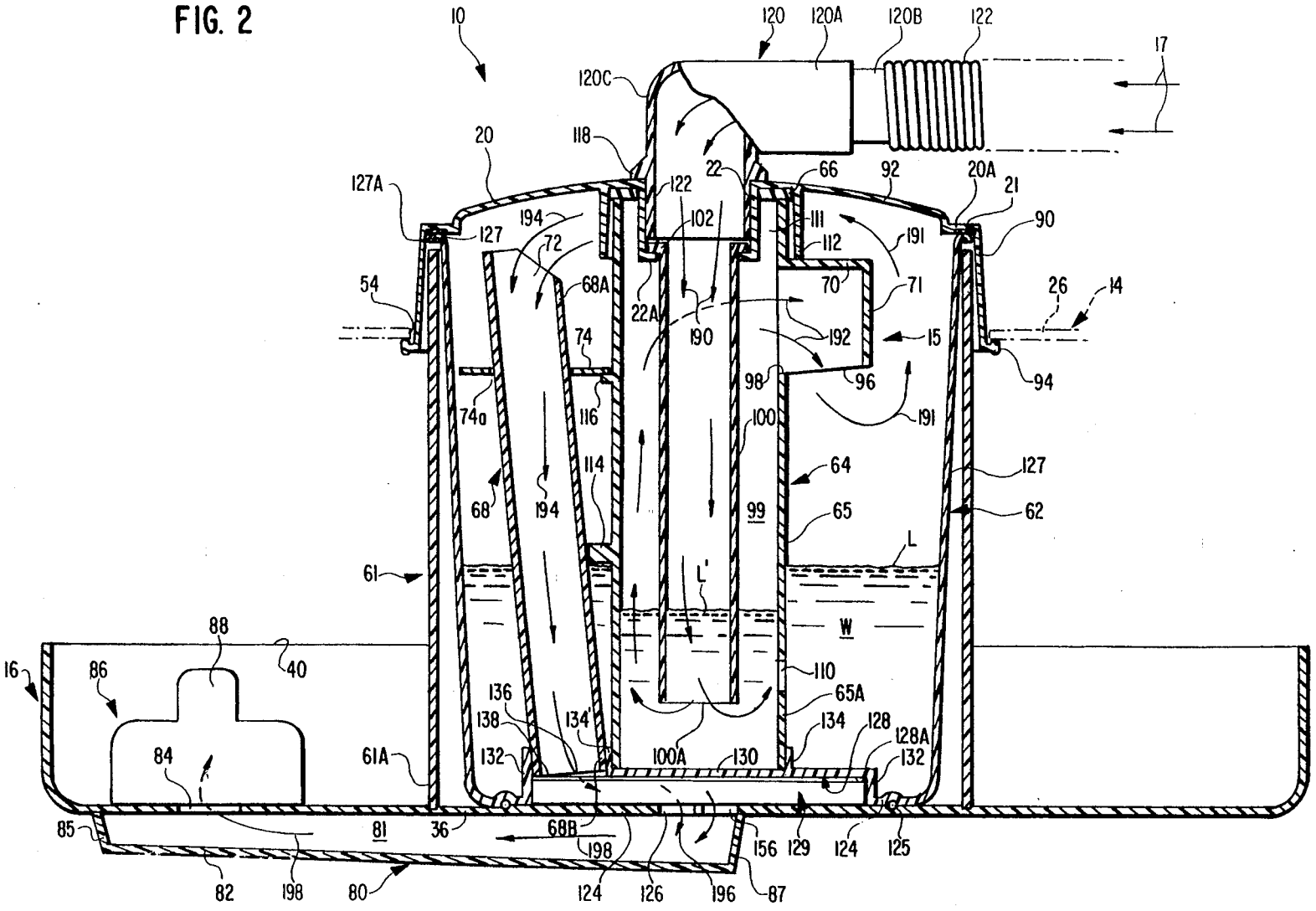
FIG. 2 is a vertical sectional view of an improved dust free, allergy free hydropneumatic filter system within the hot water vacuum extraction machine of FIG. 1.
Figure 3:
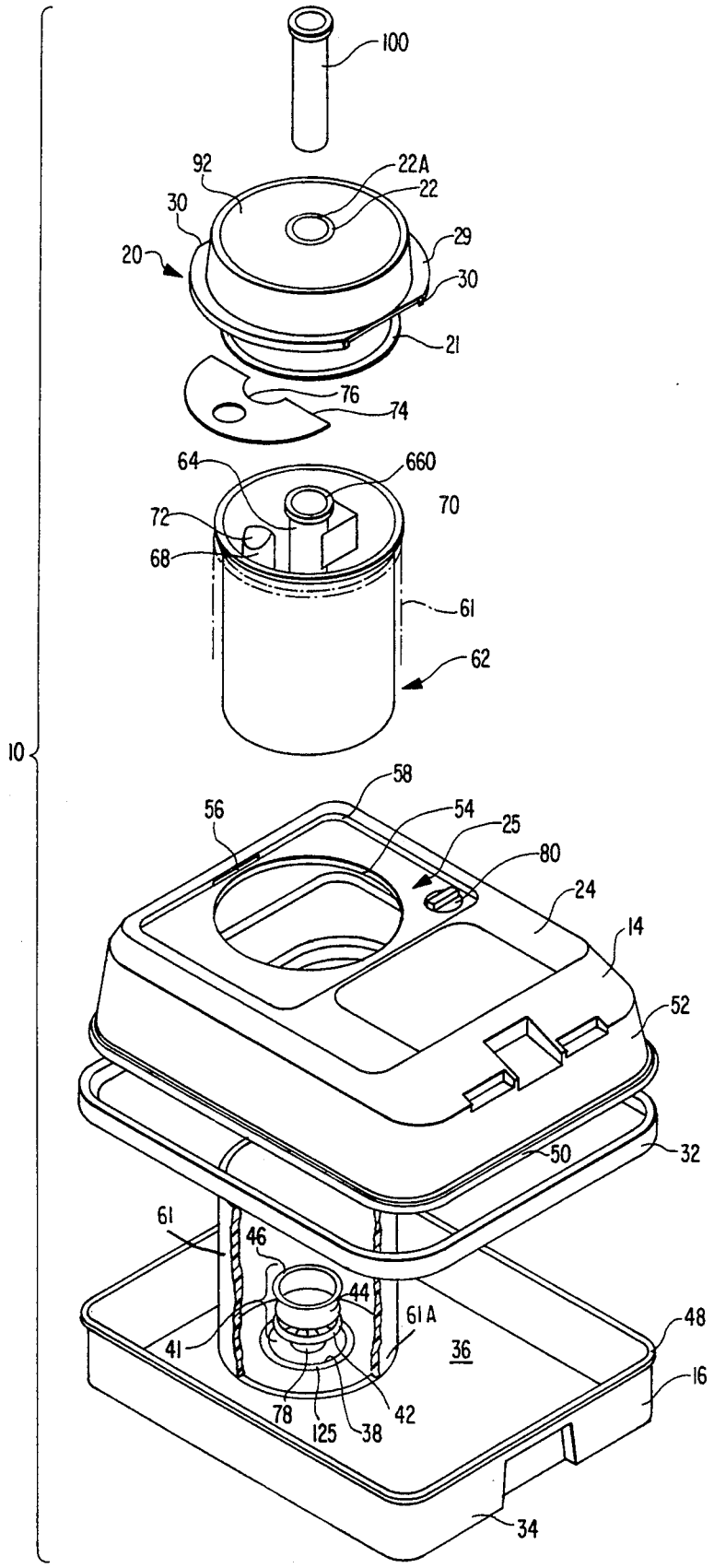
FIG. 3 is an exploded view of the major components of the improved hydropneumatic filter system of FIG. 2.

Internally of the casing 12 is located a vacuum pump indicated generally at 86, FIG. 2, which is mounted to the bottom wall 36 of the lower case 16 on the left side of the case, FIG. 1, topped by a vac motor 88. The case 16 also carries a water pump for pumping water from the solution tank within case 14. Access to the solution tank is via a recessed wall portion 26 of the top wall 24 of upper case 14 fitted with a solution tank cap 80, FIG. 3. The solution tank, normally stores hot water which is poured preferably in a solution form, including a detergent into the interior of the tank upon removal of cap 80. Mounted within the solution tank defined principally by a portion of the internal volume within casing 12, and sealed off by a cylindrical wall 61, is a removable recovery tank or dump tank, indicated generally at 62. The recovery tank 62, which is used in part during the machine operation under wet vacuum extraction mode, has internally mounted therein, FIG. 2, a hydropneumatic water filtration system indicated generally at 15. The system 15 involves principally the interaction of water and air to separate dirt particles from the return air and dirt stream from a carpet, upholstery or the like being cleaned as indicated by arrows 17, FIG. 2. The return air stream 17 passes through a vac hose 122, coupled to a reduced diameter portion 120B of a dome inlet elbow 120, with a vertical portion 120C, thereof mounted to inlet port 22 of the dome 20. Such hydropneumatic water filtration device 15 incorporates basic structural elements in much the same manner as U.S. Pat. Nos. 4,078,908; 4,083,705 and 4,145,198 noted above. Recovery tank 62 mounts within a large diameter aperture or opening 54 within the upper case recess wall 26, being fitted into cylindrical wall 61 and has a flat horizontal recovery tank bottom wall 124 in sealed contact with the upper surface of lower case bottom wall 36, FIG. 2. A circular compressible O-ring seal is interposed at 125 between the bottom wall 124 of the recovery tank and the lower case bottom wall 36. The lower edge 61A of the cylindrical wall 61 is adhesively sealed to the bottom wall 36 of lower case 16. The top of the recovery tank sidewall 127 terminates in a rounded rim 127A. The dome 20 has a horizontal, relatively flat portion 20A which connects the curved convex top 92 with an outwardly flared conical sidewall 90 and which incorporates within the bottom of that horizontal flat portion 20A an annular elastomeric sealing ring 21 which rides on rim 127A of the recovery tank. Thus, in operation, as a result of the vacuum pressure internally within the recovery tank, the dome 20 is maintained sealed against the rim 127A of the recovery tank. Suction is applied to the interior of the recovery tank 62 by vac motor 86.

Similar to the three patents above, the hydrodynamic water filtration system as indicated generally at 15 is formed principally of a water and air mixing tube structure indicated generally at 64, an internal, vertically positioned fluid return tube 100 having a radially outwardly projecting, lip 102, which seats on a radially inwardly directed annular flange 22A at the lower end of a dome inlet duct 22. The fluid return tube 100 is therefore maintained by gravity in the position shown in FIG. 2, supported by dome 20. A larger diameter water entraining tube 65 is sized so as to be spaced radially at some distance from the return tube 100 and is fixedly mounted to a raised bottom wall portion 130 of the recovery tank. A large diameter vertical wall 132 integrally molded to the recovery tank bottom wall portion 130, rising vertically upwardly therefrom. The tank bottom wall 124 includes a central recess at 124A defined by a large diameter circular wall 132 and raised bottom wall portion 130. The recess wall portion 130 carries a small diameter circular vertical wall 134 sized to snugly receive the lower end 65A of the water entraining tube 65. The water entraining tube 65 is sealed off at its bottom against raised wall portion 130. One or more water inlet ports 110 open up to the interior of the water entraining tube 65 above the recessed bottom wall 108. The water inlet ports 110 are below the level L of the water W, normally retained within the recovery tank.

For dirt and dust filtration of the return stream 17, FIG. 2, water W must be at such a level within the bottom of the recovery tank as to rise above the level of the water inlet port or ports 110 in water entraining tube 65. Similarly for the desired action, the length of the fluid return tube 100 must be such that its lower end 100A is at some distance above the recessed wall 108 sealing off the lower end of the water entraining tube 65. Water penetrates the interior of the water entraining tube 65 and enters the lower end of the fluid return tube 100. This requires the incoming return fluid, as per arrows 190, to percolate through the water W as it passes downwardly about the lower edge 100A of the fluid return tube and seeks escape through the annular space 99, between the fluid return tube 100 and the water entraining tube 65. The upper end of the water entraining tube 65 terminates in an annular rim or wall 66, which seats within an annular space 111 defined by the inlet duct 22 of the dome 20 and a downwardly projecting, large diameter annular wall 112 of dome 20 which concentrically surrounds the dome inlet duct 22 and is spaced radially outwardly thereof. Below annular wall 112, the water entraining tube 65 is provided with an opening 98, covered by a radially projecting inverted U-shaped member 70 integral with wall 65, which is closed off by vertical side walls 71 and which is open radially at 95 and downwardly at 96 to form a discharge passage for return air, after entrainment of the dirt particles within the water W, during travel of the air return beneath the level L, of the water, partially filling the lower end of mixing tube structure 64. The air as per arrows 191 free of dirt, to a major extent, tends to circulate within the space defined by dome 20 and recovery tank sidewall 127 above the water level L, subject to suction pressure from the vac motor 86. Projecting radially outward of the larger diameter water entraining tube 65 is a first radial projection 116, which supports a riser tube guide plate 74 which is apertured at 74A so as to hold and maintain the upper end 68A of a riser tube 68 in position. Riser tube 68 is at a slight inclination, partially maintained at that position by a second radial projection 114 on the exterior surface of the water entraining tube 65 facing the riser tube 68. The lower end 68B of the riser tube fits within a small diameter circular wall 134' and abuts horizontal recessed wall portion 130, within which is a circular hole sized to the bore within the riser tube 68 and to which bottom wall 130 the lower end of the riser tube 68 is sealed. This permits the escaping air stream, freed of a large percentage of the dirt by water entrainment within water W, to pass into an air filter chamber indicated generally at 128, partially defined by recess 124A. Within that chamber 128, is positioned an air filter cartridge or assembly indicated generally at 129. Chamber 128 opens axially downwardly through a relatively small diameter, circular exhaust port 126 within the bottom case, bottom wall 36. The vacuum pressure generated by vac motor 86 at a suction inlet port 84 within the bottom case bottom wall 36 is communicated to the riser tube 68 via an elongated channel member 80 having laterally opposed sidewalls 81, a bottom wall 82, as well as longitudinally opposed end walls 85, 87, all integrally molded with the bottom case 16 or sealably affixed thereto by adhesive or the like and depending therefrom. It is important that the channel member 80 be sealed off from the outside of the bottom case 16 with the exception of the chamber 128 outlet port 78 and suction inlet port 84 within case bottom wall 36. It is important that the water W within the bottom of the recovery tank not penetrate the interior of the riser tube 68, the air filter chamber 128, or the interior of the channel member 80. This is partially accomplished by suitable sealant or adhesive between the lower end 68B of the riser tube and recess wall portion 130 and between the exterior surface of the water entraining tube 65 at its lower end 65A and the interior surface of the small diameter circular wall 134 of the mixing tube support structure. While U.S. Pat. No. 4,367,565, issued Jan. 11, 1983 and entitled "DOUBLE INSULATED WET/DRY VACUUM EXTRACTION MACHINE" does not include the same hydropneumatic water filtration system as that at 15 in this application, the content of U.S. Pat. No. 4,367,565 is incorporated by reference herein, since it utilizes a two-part casing and many of the same components including the water pump, the vacuum pump and vac motor structure necessary to wet/dry vacuum extraction machines that are small, compact and may be readily carried by a housewife or the like. In prior wet/dry vacuum extraction machines as exemplified by U.S. Pat. Nos. 4,078,908; 4,145,198 and 4,367,565, filter screens are employed in the area of the inlet at the top of the riser tubes to filter out any large diameter particles or water droplets carried by the air after dirt entrainment from the return flow stream, within the water W of the dump buckets or recovery tanks of respective units. However, in the vicinity of the bottom of the riser tubes or pipes, only seal members were provided to seal off of the lower ends of the riser tube and the elements of the machine making up a passage, via a channel member or the like, from the riser tube to the vacuum pump.

The present invention is directed to providing a 100% effective micron size filtering system for ensuring that air contaminant particles of even micron size are extracted from the air stream moving under vacuum pressure down through the riser tube. Such return fluid cools the vac motor prior to being discharged through vents or openings 23 within the lower case, FIG. 1, to the atmosphere. The vent openings 23 are defined by a plurality of closely positioned, but longitudinally spaced vertical louvers 16A, FIG. 1.

Referring to FIGS. 4, 5, 5A, 5B and FIG. 6, a filter cartridge or filter assembly indicated generally at 41 is sized to and fits within the filter chamber 128. It is formed by three elements; an open frame, filter base member 42, a snap fitting filter disk retaining ring 46, and an interposed filter disk or pad 44.

The filter base member 42, as best seen in FIGS. 4 and 5, consists of an outer ring 150 of circular form, joined by radial spokes 154 to a smaller diameter inner ring 172. The spokes are twelve in number and circumferentially spaced evenly. The open frame filter base member 42 and the filter disk retaining ring 46 are formed of molded plastic, but may be formed of metal or other material. Three of the spokes 154 circumferentially offset by 120%, extend longitudinally through the inner ring 172 to meet at apex 170 of the assembly. The spokes 154 and the rings 150, 172 define, for the open frame base member 42, three pie shaped interior openings 178, interiorly of the inner ring and twelve exterior openings 176 between the inner ring 172 and the outer ring 150.

The outer ring 150 is of L-shaped cross-section, FIG. 4, with an annular sidewall 152 at right angles to an integral, annular bottom wall 153. The sidewall 152 gives strength to the inner ring portion of the filter base member 42. At three, 120° circumferentially spaced locations, a pair of grooves 162 are provided within the peripheral edge 160 of the annular sidewall 152, to create integral flexible locking tabs 164, which flex about a flex line 165, FIG. 5A. On the radially inner surface of the flex tabs 164, there is provided a transverse, inwardly projecting, triangular cross-sectional shaped locking rib 166 which projects slightly from the inner peripheral surface of the annular sidewall 152. Further, the edges 154A of the spokes 154 facing in the direction of the annular sidewall 152 taper at an angle $\alpha$ of approximately 5° such that the spokes increase in height in a direction from the annular sidewall 152 towards apex 170. At the center of the open frame filter base member, the three spokes 154, having radial extensions at 154B merge at apex 170. These spoke extensions include integral axial projections 156 to form axial seating shoulders 158 to center the filter cartridge 41 within the outlet port 126 of the lower case bottom wall 36, FIG. 2. As may be appreciated from the exploded view of FIG. 4, filter disk 44 is sized such that its diameter is generally equal to the internal diameter of the annular sidewall 152 of the filter base member outer ring 150. The filter disk 44, which may be of open pore urethane foam or the like, may be approximately 6 inches in diameter and of a thickness on the order of 0.3 to 0.4 inches. The disk has opposed coplanar faces 44B, 44C, one face of which contacts the open frame base member 42 and the opposite face contacts the filter disk retaining ring 46.

The filter disk retaining ring 46 is formed principally by an annular wall 180 axially extending having a radially outer diameter on the order of the radially inner diameter of the annular sidewall 152 of the open frame base member. A radially outwardly projecting top flange 182 is formed integrally with the annular wall 180, at one end, and a radially inwardly projecting bottom flange 184 is formed integrally with the annular wall 180, at the opposite axial end thereof. Adjacent to the top flange 182, the outer periphery 185 of the annular wall 180 is provided with a plurality of serrations at 186 as circumferential projections of ring form defined by fine radial projections which act to engage the annular locking ribs 166 projecting radially inwardly at the outer peripheral edge of the flexible locking tabs 164. As may be appreciated, by pressing the filter retaining ring against the filter disk 44, the filter disk is forced to compress against the spokes 154 of the open frame filter base member 42 until the edge 152A of the annular sidewall 152 abuts the top flange 192 of the filter disk retaining ring 46. In so doing, the locking ribs 166 of the flexible locking tabs 164 engage serrations 186 on the outer periphery of the filter disk retaining ring annular wall 180, securing the filter retaining disk with a snap fit to the open frame filter base member 42. The face 44B of the filter disk facing the open frame filter base member 42 presses against the oblique upper edges 154A of the tapered ribs 154. The ribs 154 carry the V-shaped circular filter holding rib 168, which presses into a face 44C of the filter disk. Similarly, the bottom surface of the bottom flange 184 of the filter disk retaining ring 46 is provided with a pair of V-shaped circular projection ribs 187, which project axially therefrom at a slight distance. These circular projection ribs bite into the upper surface 44B of the filter disk 44 and act with circular projection rib 168 of the filter base member 42 to maintain the disk in its axially centered position, nested within the upper recess portion of the open frame filter base member, with the filter disk retaining ring 46 snapped into locking engagement with open frame base member 42 via the three flexible locking tabs 164. The filter disk 44 may be a washable, reusable urethane foam open pore foam element having little structural integrity of itself, but securely maintain into position with minimal interference with the open pore structure and permitting the filter disk to capture any particulate matter carried by the return flow stream passing downwardly through the riser tube 68. Alternatively, where it is desired to remove even micron sized particles, an electrostatically charged 100% efficient disposable allergy filter disk of the same general dimensions may be substituted for the reusable secondary urethane foam filter disk 44. Depending upon the structural strength of the open pore filter disk employed, it may not be necessary to utilize the filter cartridge or filter assembly 41 in the form shown in FIG. 4, and an open pore molded plastic filter pad sized to the vertical height and horizontal width of the filter chamber 128 may be positioned therein. Where the allergy filter is employed, it has sufficient structural integrity to maintain its position and shape so as to fill the filter chamber and to intercept the incoming return air flow through the riser tube and to filter out all of the contaminants within that stream, even those of submicron size. The allergy filter may be an open pore disk manufactured by the 3M Company under its trade name FILTRETE, Model No. G0120; 200 gm/m$^2$ basis weight. The overall height of the filter holder assembly with filter disk in place and captured between the retaining ring and the filter base member is approximately 0.5 inches, and the diameter of the assembly is approximately 5.6 inches. The open frame filter base member and the filter disk retaining ring may be suitably molded of NYLON®. Such material is sufficiently elastic to provide the necessary flexibility to the three locking tabs, which flex about their flex lines 165. It should be appreciated that when using the urethane foam filter in hot water extraction mode, the urethane foam filter should always be mounted within the secondary filter holder or filter cartridge 41 formed of the snap fitted filter disk retaining ring 46 and the open frame filter base member 42. The same precaution is even more necessary when using the disposable electrostatic allergy filter such as the FILTRETE TM disk or pad by the 3M Company.

In operation, the machine irrespective of wet or dry mode, and indeed when functioning solely to remove micron sized particles within a given environment such as a room within the house and with the vac hose removed and with the upper end of the aqua filtration tube 100 open to the atmosphere through the dome inlet port 22A defined by the annular wall 22 of that dome, FIG. 1, the incoming stream as indicated by the arrows in FIG. 2 at 190, is caused to pass downwardly through the water level L' within the mixing tube structure 64 and specifically the lower end of the fluid return tube or aqua filtration tube 100 to percolate through the water and to pass under the lower edge 100A of the tube. Whereupon, the air escapes upwardly in the annular space 99 between the smaller diameter aqua filtration tube 100 and the larger diameter water entraining tube 65. Under suction pressure from the vacuum pump 86, the near particle free air as per arrows 192 exits from the mixing tube structure 64 and enters the interior of the recovery tank 62 above the water level L within that tank. The air escapes as per arrows 194 downwardly through the riser tube 68, whose lower end is open to the filter chamber 128 between the recovery tank bottom wall 124 and recess wall portions 130 of the tank bottom 124. This air stream in accordance with arrows 196 passes through an open pore filter disk, whether it be an urethane filter disk 44, a 3M FILTRETE TM filter disk, or their equivalents, held within the secondary filter holder 41, or otherwise.

The 100% clean air, or near 100% clean air, exits from the filter chamber 128 and the air filter assembly 41, exhaust port 78 through holes within the tank bottom wall 24, and the lower case bottom wall 36 and passes through channel member 80 as per arrows 198 to the inlet port 84, opening to the bottom of the vacuum pump 86. Such return air then exits through an exhaust port (not shown) within the bottom wall 36 of the lower case 16, next to channel member 80. Outside air entering louver openings (not shown) of the lower case 16 located on the right front side functions to cool the vac motor armature chamber prior to exhausting through louver openings 23 located in the rear left side of the bottom case 16. A sound box (not shown) surrounds the vacuum pump 86 below vac motor 88.

As may be appreciated, this permits the hot water vacuum extraction machine 10 to be used in a number of different modes, such as the picking up of liquids, i.e. wet vacuuming of hard surfaces such as concrete basement floors, or the like; conventional hot water extraction of carpeting or upholstery conventionally termed "steam cleaning", or machine operation for room air washing or inhalation/deodorizing. In the latter mode, the machine functions to filter the air in the environment in which it is positioned, thus providing a dust free atmosphere as a healthier home environment or the like. The applicant advantageously uses this machine by adding to water W, a few drops of a eucalyptus/menthol inhalant for therapeutic inhalation purposes, or a few drops of aromatic fragrance, producing a fragrant or menthol vapor atmosphere within the room and giving a fragrant or clean scent as desired.

While the invention has been described in detail with reference to a specific embodiment thereof, it will be apparent to one skilled in the art that various changes and modifications may be made therein within departing from the spirit and scope of the invention.

What is claimed is:

1. In a hot water vacuum extraction machine comprising:

an outer casing of electrical and thermal insulation material having a bottom wall, a top wall and generally vertical sidewalls, a circular opening within said top wall, a removable tubular recovery tank positioned within said circular opening within said top wall, a dome overlying the circular opening within said casing top wall, a hydropneumatic water filtration system within said recovery tank including a mixing tube structure extending upwardly from and supported by a recovery tank bottom wall including an aqua filtration tube coupled to a dome inlet duct within said dome at one end and extending coaxially within a larger diameter water entraining tube, said water entraining tube being closed at its bottom and spaced axially from an open lower end of said aqua filtration tube, at least one water inlet port within said water entraining tube opening to the interior of said recovery tank and being open to an annular space between said concentric water entraining tube and said aqua filtration tube, such that liquid filling the recovery tank above the level of said at least one water inlet port is aspirated by return fluid moving through contaminants within said return fluid entering said annular space in the vicinity of said water inlet port to cause contaminants within said return flow to be entrained by said water for primary filtration of said return flow stream, a hollow riser tube extending upwardly from the bottom of said recovery tank and being open at a level above the level of water within said recovery tank, and means for applying vacuum pressure to said riser tube at the bottom of said recovery tank to effect filtering of the return fluid stream, the improvement comprising:

means within said recovery tank and interposed between the bottom wall of said recovery tank and said outer casing defining an air filter chamber, means for sealing the bottom of the riser tube to said tank bottom wall and open to said air filter chamber, means within said recovery tank bottom wall and said case for defining a sealed outlet for said return fluid stream and being open to said source of vacuum pressure, and a secondary filter holder assembly mounted within said air filter chamber and comprising a perforate filter holder supporting internally an open pore filter element, whereby said secondary air filter may remove contaminants of submicron size to render the air discharging from the case virtually contaminant free.

2. The hot water vacuum extraction machine as claimed in claim 1, wherein said filter element is an open pore urethane filter element.

3. The hot water vacuum extraction machine as claimed in claim 1, wherein said filter element is a FILTRETE TM G0120 open pore allergy filter element of 200 gm/m$^2$ basis weight.

4. The hot water vacuum extraction machine as claimed in claim 3, wherein said filter element is heat sealed around the periphery thereof to render the periphery of the filter element imperforate.

5. The hot water vacuum extraction machine as claimed in claim 1, wherein said secondary filter holder comprises an open frame, circular base member, and a filter disk retaining ring snap fitted thereto, and said filter element is of circular disk form and interposed between said open frame base member and said filter disk retaining ring snap fitted thereto.

6. The hot water vacuum extraction machine as claimed in claim 5, wherein said open frame filter base member comprises an annular outer ring, an annular inner ring of smaller diameter, a plurality of spokes extending radially inwardly from the outer ring and being integral with said inner ring and defining a plurality of pie shaped openings about the base member, wherein the outer ring includes an annular sidewall extending parallel to the axis of the open frame filter base member, said annular sidewall including a plurality of circumferentially spaced closely adjacent narrow grooves extending axially inwardly from the edge of the annular sidewall remote from said spokes and defining therebetween flexible locking tabs, and wherein said flexible locking tabs each include a locking rib projecting radially inwardly proximate to an outer edge of said annular sidewall, and wherein said filter disk retaining ring comprises an annular sidewall extending parallel to the axis of the filter disk retaining ring and having a radially outwardly projecting top flange, and wherein a filter disk retaining ring on a radial outer surface of the annular wall proximate to said top flange comprises serrations, and wherein the outer periphery of the filter disk retaining ring is sized slightly smaller than the inner diameter of the annular sidewall of the open frame filter base member, wherein the filter disk interposed between the top of the open frame filter base member and the bottom of the filter disk retaining ring is sandwiched therebetween, with the locking rib of said flexible tabs in snap fit engagement with the serrations on the outer periphery of the annular wall of the filter disk retaining ring, with the outer edge of the filter base member annular sidewall abutting the top flange of said filter ring.

7. The hot water vacuum extraction machine as claimed in claim 6, wherein said filter disk retaining ring further comprises a radially inwardly directed bottom flange integral with said annular wall, overlying a face of said filter disk and compressing the peripheral edge of the filter disk into contact with the bottom wall of said filter base member outer ring.

8. The hot water vacuum extraction machine as claimed in claim 7, wherein the bottom surface of the bottom flange of said filter disk retaining ring includes at least one filter disk holding rib projecting axially outwardly thereof in the direction of the filter disk, and the top surface of the bottom wall of said filter base member outer ring comprises a circular, axially outwardly projecting rib engaging the face of said filter disk opposite that in engagement with said filter disk retaining ring bottom flange, said filter disk holding ribs of said filter base member and filter disk retaining ring acting to prevent movement of the filter disk radially within said secondary filter holder assembly comprised of said open frame filter base member and said snap fitted filter disk retaining ring.

9. The hot water vacuum extraction machine as claimed in claim 6, wherein the spokes are tapered and increase in thickness in a direction from the outer ring towards the inner ring such that a central portion of said circular filter disk is compressed to a greater extent than that in the vicinity of the outer periphery of the filter disk during snap fitting engagement of the filter disk retaining ring to the open frame filter base member.

10. The hot water vacuum extraction machine as claimed in claim 6, wherein a plurality of said spokes in the vicinity of said apex include integral, axially extended projections defining secondary filter holder assembly location shoulders of a diameter slightly smaller than the diameter outlet port within the case bottom wall and projecting therein thereby fixing the position of the secondary filter holder assembly and its filter disk within said air filter chamber.

* * * * *